US005813461A

United States Patent [19]

Theisen

[11] Patent Number: 5,813,461

[45] Date of Patent: Sep. 29, 1998

[54] CO-AXIAL WELL CONSTRUCTION TECHNIQUE FOR HAZARDOUS WASTE ASSESSMENT AND REMEDIATION

[76] Inventor: Joseph P. Theisen, 1535 Oak St., Apt. #2, San Francisco, Calif. 94117

[21] Appl. No.: 679,229

[22] Filed: Jul. 12, 1996

[51] Int. Cl.[6] ..... E21B 49/08; E21B 33/047

[52] U.S. Cl. ..... 166/264; 166/97.5; 166/242.1

[58] Field of Search ..... 166/51, 89.1, 89.2, 166/97.5, 242.1, 242.3, 313

[56] References Cited

U.S. PATENT DOCUMENTS

| | | | |
|---|---|---|---|
| 2,261,292 | 11/1941 | Salnikov | 166/313 X |
| 2,885,008 | 5/1959 | Hoffer | 166/89.2 X |
| 2,994,380 | 8/1961 | Tausch et al. | 166/242.3 X |
| 3,011,552 | 12/1961 | Rhodes et al. | 166/97.5 X |
| 3,039,535 | 6/1962 | Hathorn et al. | 166/313 X |
| 3,195,638 | 7/1965 | Rouax | 166/89.1 X |
| 3,976,130 | 8/1976 | Chambless et al. | 166/89.1 |
| 5,092,401 | 3/1992 | Heynen | 166/89.1 |

*Primary Examiner*—Frank Tsay
*Attorney, Agent, or Firm*—David Dolberg, Esq.

[57] ABSTRACT

A device for use in remediation of a multiplicity of adjacent subsurface geologic strata is described. The device comprises co-axially or concentrically positioned conduits installed in a borehole with an inner conduit extending below an outer conduit through a seal attached to the distal end of the outer conduit. The distal ends of both the outer, upper and the inner, lower conduits are perforated to allow the flow of liquids or gases through the conduits between ground surface and the geologic stratum adjacent to the perforated sections of both conduits. The annular spaces between the borehole wall and the unperforated portions of both the inner and outer conduits are sealed with impermeable barrier plugs to prevent flow parallel to the borehole axis between the borehole wall and the outer surface of the conduits. The annular spaces between the perforated sections of both conduits and the borehole wall is filled with a permeable granular filtration material.

9 Claims, 1 Drawing Sheet

CO-AXIAL WELL CONSTRUCTION TECHNIQUE FOR HAZARDOUS WASTE ASSESSMENT AND REMEDIATION

FIELD OF INVENTION

The invention relates to the assessment and clean up of soil and ground water contamination and specifically to an improved method for construction of ground water monitoring and remediation wells.

BACKGROUND OF THE INVENTION

Contaminants released at the ground surface migrate downward through unsaturated soils (also known as vadose soils) until they reach the water table (the top of the saturated zone). In migrating downward the contaminants usually encounter horizontally-oriented distinct soil horizons or strata that, because of varying hydraulic conductivities, greatly affect the rates and directions of contaminant movement. These stratigraphic variations also affect contaminant movement in the saturated zone. Removal or remediation of soil and/or ground water contaminants is extremely difficult, and is made more so if the contaminant distribution is complicated by variable stratigraphy.

Contaminant Assessment Techniques: Contaminant distribution in unsaturated sediments is usually accomplished by the drilling of boreholes in the area in and around a suspected chemical release and the collection and subsequent chemical analysis of soil samples to determine the amounts, if any, of the released chemical at the location of the borehole (Fetter, 1988). Ground water contamination is usually assessed or characterized by installing sections of perforated PVC or steel pipes and filter material known as ground water monitoring wells into boreholes that extend below the water table, and then collecting and analyzing ground water samples from the monitoring wells. Because the migration of contaminants dissolved into ground water is greatly controlled by the physical and chemical characteristics of the soil strata, it is essential that individual permeable or transmissive saturated soil strata (known as water-bearing zones when they are limited in thickness and areal extent) be sampled by a well constructed only in the zone of interest (Fetter, 1988). If more than one zone is intersected by the monitoring well screen, then two common problems result: 1) it is difficult to accurately assess the concentration of the contaminant in that particular zone because the long well screen allows water from an overlying or underlying clean zone to dilute the water from the contaminated zone, and 2) the longer screen allows the contaminant to migrate down (or up) the wellbore, thereby contaminating a previously clean zone.

Contaminant Remediation Methods: Contaminants can often be removed in-place or "in-situ". In-situ remediation techniques usually rely on drawing out or extracting contaminants from saturated or unsaturated soils or by injecting contaminant-degrading substances (most often biological agents) into soils. Similar to contaminant assessment techniques, it is extremely important that the extraction or injection be focussed on individual soil strata that contains the contaminants. Otherwise, significant resources are expended in treating clean zones. For this reason, most remediation programs use extraction wells made of short sections of perforated conduit placed into carefully selected individual soil horizons.

Highly specialized techniques are used to extract contaminants from both unsaturated and saturated sediments.

Techniques used to clean up saturated sediments are known as "ground water" remediation techniques and those used to treat unsaturated sediments are known as "soil" remediation techniques. Typical ground water remediation approaches for treating organic contaminants are Ground Water Extraction" (GWE) in which pumps are installed in wells and are then used to withdraw contaminated ground water, "Air Sparging", which combines air injection into saturated soil and air withdrawal above the air injection point, and "Bioremediation" which promotes the growth of contaminant-degrading microorganisms in the contaminated strata. One of the most common soil remediation techniques is Soil Vapor Extraction (SVE), (see U.S. Pat. No. 4,593,760 and Grasso, 1993) whereby a high powered vacuum blower connected to a vadose-zone well and is used to remove vapor-phase contaminants from unsaturated soils. All of these techniques are most effectively applied using short-screen extraction or injection wells that are constructed to focus on individual contaminated zones.

Removal of Contaminants from Multiple Horizons: Although occasionally subsurface contaminants are confined to only one narrow soil horizon, more commonly the contaminants are distributed in multiple horizons that each exhibit differing hydraulic properties. For this reason, site assessments and remediations typically require installation of several sets of vertically displaced or "nested" monitoring and extraction wells that allow the contaminants in each individual zone to be individually assessed and remediated. Current industry practice constructs nested wells in one of two ways: 1) each zone is penetrated by an individual borehole, a single perforated screen is then placed into the borehole to intersect only the zone of interest, and the next deeper (or shallower) horizons are then assessed with an entirely separate borehole and well located within a few feet of the initial well (see Boyle, 1991), or 2) a single large-diameter borehole that is typically a minimum of 4 inches and a maximum of 24 inches, but more likely 6 inches to 12 inches, is drilled through the entire thickness of contaminated strata and individual, vertically offset well screens are then placed into the large-diameter borehole, with the interval between screens sealed with clay or cement to prevent cross-contamination or leakage between the screened sections.

Disadvantages of Current Practices: The two methods described above present significant disadvantages. The principal disadvantage of Method 1—unique boreholes for each screened interval—is cost. The largest portion of the cost of any well installation effort is in the time and material needed to drill the borehole. The need for a unique borehole for each screened interval dramatically increases costs. A second disadvantage of this approach is the increased amount of ground surface area needed to drill multiple wells. Not only does the need for a larger surface area complicate the placement of the wells (since most contaminated sites are industrial or commercial properties and are densely improved with structures, machinery or other surface obstructions), but it also increases costs due to the need for oversized vaults or for duplicated well head improvements.

The primary disadvantage of using Method 2—multiple, side-by-side completions in a single, large diameter borehole—is the potential for this approach to produce cross-contamination. Placement of two or more casings side-by-side in a single borehole requires the installation of a sealant between the screened intervals to prevent pressure leaks or fluid migration from one screened section to the other(s). It is very difficult to effectively place these seals because 1) borehole walls are typically unstable allowing sidewall slough to either block placement of the seals or to create high permeability sections within a sealed interval, and 2) it is very difficult to ensure that an adequate seal is placed between the side-by-side well casings. To further describe this second problem, it is equally as important to place the sealant between the individual casings as it is to place it between the casings and the borehole wall. It is virtually impossible to prevent the casings from coming into contact with one another as they are placed into the borehole and as they are being sealed. Even when using spacers between the casings, most installations cause the dual casings to spiral downward into the borehole, resulting in a "helix-like" configuration that allows substantial contact between the individual casings. Casings that are in contact with each other cannot provide adequate sealing over the interval that they touch because the sealants must typically occupy at least a 2 inch-thick area around the individual casings to provide an adequate barrier to fluid flow. For this reason, most governmental authorities charged with overseeing well installation activities require at least a 2 inch thick seal. Because of the high liabilities associated with remediation of hazardous material releases, the potential for cross contamination caused by the poor sealing characteristics of side-by-side-casing nested wells is a major drawback to their use.

SUMMARY OF THE INVENTION

The objects of this invention are to provide a device that allows the withdrawal or injection of fluids into or out of geological stratum at lower cost, with less area needed for installation and with improved borehole seal integrity than is available using current industry practices. These objects are further described below.

Reduced Cost: Using a coaxial construction technique reduces cost because: 1) only a single, smaller borehole that ranges from 4 to 18 inches in diameter, but more commonly 6 to 12 inches in diameter is needed rather than multiple individual boreholes or a larger diameter single borehole. Cost is further reduced compared to the multiple borehole approach because the well heads can be manifolded with simple fittings and because all well head improvements can be contained in a single vault, placed either above or below ground surface. Cost is also reduced using this device because the construction procedures are much simpler than those for traditional side-by-side nested well construction. By lowering individual well casings sequentially over the previously installed casings the device allows greater separation between the single casing and the borehole wall. This greater separation prevents the borehole sidewall failure or entanglements between the multiple casings that often accompany the construction of traditional side-by-side wells.

Reduced Installation Area: The coaxial installation requires significantly less surface area for the well vault compared to the multiple borehole technique because all the casings are contained in a single borehole, allowing use of a small (often 8 by 36 inch but more commonly 16 by 24 inch) well head vault or a single above-ground completion commonly known as a "stovepipe" completion. The small surface area needed allows coaxial wells to be used in highly congested areas.

Improved Borehole Seal Integrity: The greatest advantage to the use of the co-axial construction is the easier and more secure well sealing it allows between screened intervals. Seals are placed around co-axial wells in a manner identical to that used for traditional single-completion wells, with the sealing material only needing to fill a single, uninterrupted void space between the well casing and the borehole wall. Since only the space between the outer conduit of a co-axial well and the borehole wall needs to be filled with sealant, (traditional side-by-side nested wells require this space as well as the gap between the individual casings to be sealed) co-axial wells are much more likely to maintain their integrity and to prevent cross-contamination between zones compared to traditional nested wells.

In accordance with the above objects and those that will become apparent below, the device comprises:

an inner conduit with an outer surface and a distal first end and a proximal second end, a seal closing the distal first end and a plurality of perforations adjacent to the distal first end, said inner conduit positioned axially within a borehole with an inner wall traversing an upper subsurface stratum, and at least part of a lower stratum, each stratum with an upper and a lower border. Said conduit positioned such that the distal first end and adjacent perforations are located within the lower stratum;

a distal granular filtration material surrounding the perforated interval of said inner conduit and extending adjacent to the proximal border of the most distal stratum, said filtration material extending axially from the outer surface of the inner conduit to the inner wall of the borehole;

a distal barrier plug affixed to the outer surface of the inner conduit and distal from the distal end of the inner conduit and adjacent perforations and proximal to the proximal border of the most distal stratum, said barrier plug extending from the proximal border of the aforementioned filtration material to the distal border of the proximal geologic stratum and axially from the outer surface of the inner conduit to the inner wall of the borehole and plugging the borehole thereby;

an outer conduit positioned concentric with and surrounding the inner conduit, the outer conduit having an outer surface, a distal end and a proximal end, a seal attached to the distal end of the outer conduit surrounding the inner conduit and closing the distal end of the outer conduit, and a plurality of perforations adjacent to the distal end, the outer conduit projecting such that the distal end and adjacent perforations traverse an adjacent stratum above the lower traversed stratum;

a second granular filtration material surrounding the perforated interval of said outer conduit and extending adjacent to the proximal border of the most proximal stratum, said filtration material extending axially from the outer surface of the outer conduit to the inner wall of the borehole;

a second barrier plug affixed to the outer surface of the second conduit and distal from the distal end and adjacent perforations and proximal to the upper border of the upper stratum, said barrier plug extending axially from the second conduit to the inner wall of the borehole and plugging the borehole thereby; and, the proximal ends of both conduits adapted to accept pumping remediation devices.

Further objects and advantages of this invention will become apparent from a consideration of the drawings and ensuing description.

DESCRIPTION OF DRAWINGS

For a further understanding of the objects and advantages of the present invention, reference should be had to the following detailed description taken in conjunction with the accompanying drawings in which like parts are given like reference numerals and wherein.

DETAILED DESCRIPTION OF THE INVENTION

Figure 1:
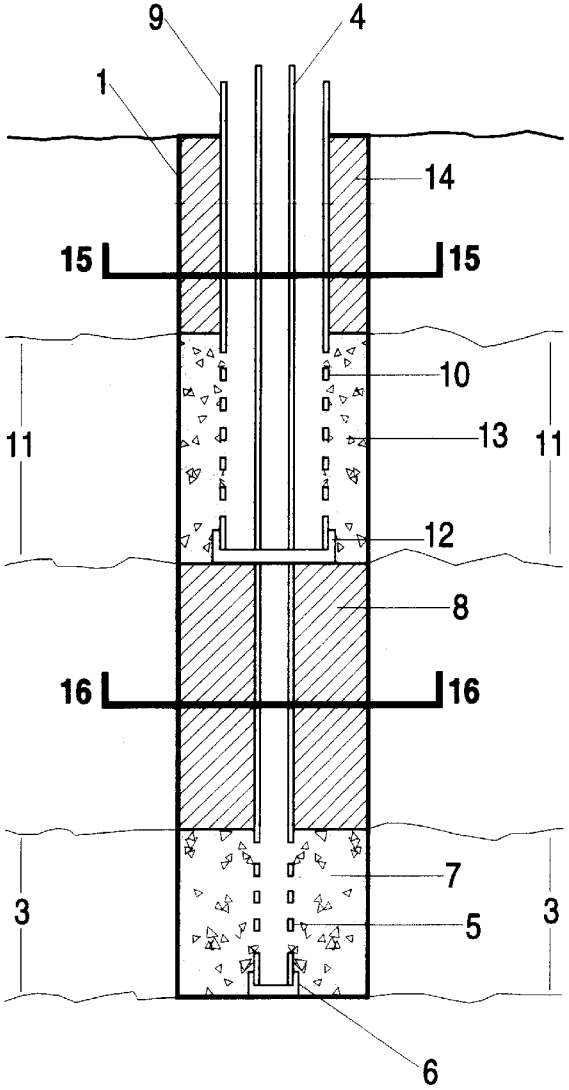
FIG. 1 is a cross-sectional diagram drawn parallel to the longitudinal axis of the device showing the main components of a device constructed in accordance with the principals of the present invention.
Figure 2:
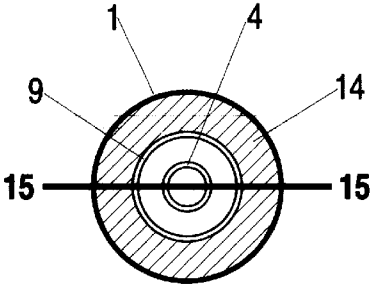
FIG. 2 is a cross-sectional diagram drawn through line A–A' of FIG. 1 perpendicular to the longitudinal axis of the device showing the relationships between the conduits and sealants adjacent to the proximal portion of the device.
Figure 3:
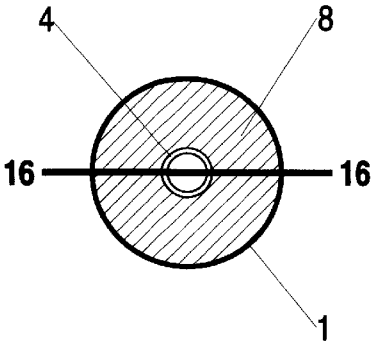
FIG. 3 is a cross-sectional diagram drawn through line B–B' of FIG. 1 perpendicular to the longitudinal axis of the device showing the relationships between the conduits and the sealants adjacent to the distal portion of the device.
Figure 4:
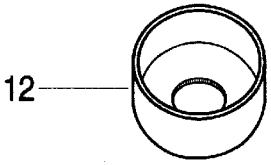
FIG. 4 is a perspective drawing showing the seal that separates the distal and proximal conduits.

The device consists of the following components:

A borehole 1 with a diameter between 4 and 36 inches but more typically between 8 and 12 inches, drilled using any one of a wide variety of drilling techniques, penetrates the ground surface 2 to the distal limit of the most distal geologic stratum of interest 3.

A first inner conduit 4 that ranges in size from ½ inch to 18 inches, but is typically between 1 and 3 inches, occupies the approximate center of the borehole. The portion of this first conduit that is most distal from the ground surface contains a plurality of perforations 5 that penetrate the entire thickness of the conduit, allowing fluids or gases to move through the conduit wall. A sealing device 6 encloses the distal end of the conduit 4, adjacent to the perforations 5. The sealing device is attached to the conduit by 1) either sliding over the outer surface of the distal end of the conduit such that friction between the inner surface of the sealing device and the outer surface of the conduit maintains the position of the sealing device and prevents fluid or gas from entering the conduit, or by 2) typical helical male/female screw threads, with the distal end of the conduit containing either the male portion of the set and the sealing device the female, or the opposite.

A granular filtration material 7 surrounds the perforated interval of the conduit and extends a short distance, which is often between 2 inches and 20 ft but more typically between 4 and 24 inches, beyond the most proximal of the conduit perforations.

A first solid or semi-solid barrier seal 8 occupies the space between the conduit and the inner surface of the borehole wall in the area between the most proximal limit of the filtration material and the distal limit of the more proximal geologic stratum, sealing the borehole between.

A second larger diameter conduit 9 that can range in size from 1 inch to 48 inches, but is typically between 2 inches and 16 inches, or even more commonly ranges from 3 to 8 inches in diameter, concentrically surrounds the first inner conduit immediately above the most proximal end of the first barrier seal. The distal portion of this conduit is penetrated by a plurality of perforations 10 that penetrate the entire thickness of the conduit. The perforations are positioned adjacent to the proximal geologic stratum of interest 11.

A second sealing device 12 seals the distal end of this second and proximal conduit. This second sealing device is sealingly connected to both the first, distal conduit and to the second, more proximal conduit. The sealing device contains a nominally round hole that is slightly larger in diameter than the outer surface of the first or inner conduit, allowing it to seal frictionally against the inner conduit. It seals either frictionally or with helical male/female screw threads against the second or outer conduit.

A second granular filter 13 surrounds the perforated interval of the more proximal conduit and extends a short distance, which is often between 2 inches and 20 ft but more typically between 4 and 24 inches, beyond the most proximal of the second conduit perforations.

A second solid or semi-solid barrier seal 14 occupies the space between the second conduit and the inner surface of the borehole wall in the area between the most proximal limit of the second filtration material and the ground surface.

Device Fabrication Procedure: The procedure used to construct the device consists of the following main tasks, described sequentially:

1) A first small diameter conduit 4 is assembled at the ground surface. The conduit ranges in size from ½ inch to 18 inches (but is typically between 1 and 3 inches), and is composed of either metal, plastic, Polyvinyl chloride (PVC), Teflon, or other malleable, flexible synthetic material. A second section of conduit 5 containing a plurality of grooves or perforations that penetrate the entire thickness of the conduit, allowing fluids or gases to move through the conduit wall (3 on FIG. 1) is then attached to one end of the first conduit using friction or screw threaded male/female couplings. The length of this perforated section coincides with the thickness of the most distal geologic stratum of interest 3 traversed by the borehole. The perforation are often between 0.005 and 0.5 inches in thickness, but are more commonly between 0.01 and 0.3 inches in thickness. A sealing device 6 is attached to the open end of the perforated section of conduit, such that the sealing device seals the distal end of the conduit from the atmosphere, and once it is inserted into the borehole, from the earth. The sealing device is attached to the conduit by 1) either sliding over the outer surface of the distal end of the conduit such that friction between the inner surface of the sealing device and the outer surface of the conduit maintains the position of the sealing device and prevents fluid or gas from entering the conduit, or by 2) typical helical male/female screw threads, with the distal end of the conduit containing either the male portion of the set and the sealing device the female, or the opposite.

A second larger diameter conduit 9 that can range in size from 1 inch to 48 inches, but is typically between 2 inches an 16 inches, or even more commonly ranges from 3 to 8 inches in diameter (6 FIG. 1), is also assembled at the ground surface. A section of larger diameter conduit 10 containing a plurality of grooves or perforations that penetrate the entire thickness of the conduit has also been previously attached to the distal portion of the larger diameter conduit using friction or screw threaded male/female couplings. The length of this perforated section has been previously determined to coincide with the thickness of the next most proximal geologic stratum of interest 11 transversed by the borehole. A second sealing device 12 is also sealingly attached to the distal end of this second or more proximal conduit either frictionally or with helical male/female screw threads. This second sealing device is composed of either metal, plastic, rubber, PVC, Teflon or other material and contains a nominally round hole that is slightly larger in diameter than the outer surface of the first or inner conduit.

2) A borehole 1 with a diameter between 6 and 48 inches but more typically between 8 and 12 inches, is drilled to the distal limit of the most distal geologic stratum of interest 3. Drilling techniques that are typically used include, but are not limited to, augering and rotary. Augering involves spinning a solid or hollow pipe, that has flat blades arranged in a helical screw configuration around its outer surface, into the ground. The helical blades cut into the underlying soils and then transport them to the ground surface. Rotary techniques create a borehole by circulating either air or a viscous drilling fluid through a leading cutting head attached to a hollow inner pipe that is advanced into the earth. The air or fluid is pumped into the hollow interior of the drill pipe to lubricate the cutting head as it advances and to transport the soil or rock particles removed during the drilling process to the ground surface.

3) Once the borehole is open and stable, the inner small diameter conduit 4 and 5 is placed into the approximate center of the borehole such that the distal end of the conduit is positioned adjacent to the distal limit of the most distal geologic stratum of interest 3.

4) A granular filtration material 7 is then placed to surround the perforated interval of the conduit and to extend a short distance, which is often between 2 inches and 20 ft but more typically between 4 and 24 inches, beyond the most proximal of the conduit perforations.

5) A liquid with chemical properties that cause it to progressively harden to a solid or a semi-solid is then pumped or placed into the space between the conduit and the inner surface of the borehole wall in the area between the most proximal limit of the first filtration material and the distal limit of the more proximal geologic stratum of interest. Once this liquid hardens it will form the first or most distal solid or semi-solid barrier seal 8. A layer of clay or expansive material may be placed on top of the granular filter 7 before the sealing liquid is placed to prevent the liquid from penetrating into the granular filter.

6) The second larger diameter conduit 9 is then placed into the borehole such that it concentrically surrounds the first inner conduit 4, with its distal end immediately above the proximal end of the distal barrier seal 8. The distal portion of the conduit is penetrated by a plurality of perforations and the sealing device 12 attached to the distal end of the outer conduit now abuts the outer surface of the inner conduit, thereby sealing the interior of the outer conduit from the earth.

7) The more proximal granular filter material 13 is next placed to surround the perforated interval of the outer conduit 10 and extend a short distance, which is often between 2 inches and 20 ft but more typically between 4 and 24 inches, beyond the most proximal of the outer conduit's perforations.

8) A liquid with chemical properties that cause it to progressively harden to a solid or a semi-solid is then pumped into the space between the outer conduit and the inner surface of the borehole wall in the area between the most proximal limit of the second filtration material and the ground surface 2. Once this liquid hardens it forms the more proximal solid or semi-solid barrier seal 14.

USE OF THE INVENTION

Remediation—Vadose Zone Only: The device can be used as a remediation well to remove volatile contaminants from two or more distinct unsaturated geologic horizons. The contaminants are removed by attaching an air moving device, commonly referred to as a "vacuum blower", to each of the conduits protruding from the top of the borehole using a manifold that allows either individual sampling and control of flow rates from each conduit or uncontrolled removal from both conduits. The blower is then activated causing circulation of clean air through the mass of contaminated soil and then up and out of the casings. The vapor-phase contaminants in the circulating air are either removed from the air stream using one of many available techniques commonly known to those in the industry or are discharged to the atmosphere. Extraction of contaminated soil vapor using the device allows the flow out of individual geologic stratum transverse by the perforated portions of the device to be individually controlled.

Remediation—Ground Water Only: The device can be used to remediate or cleanup contaminated ground water by inserting or attaching pumping devices to the proximal portions of both conduits and then activating the pumping devices such that contaminated ground water in drawn into the conduits through the perforated portions of the conduits and then up and out of the conduits. The removed ground water is either treated at ground surface using any one of a wide variety of treatment methods commonly known to those in the industry or is discharged without treatment. Extraction of contaminated ground water using the device allows the flow out of individual geologic stratum transverse by the perforated portions of the device to be individually controlled.

Remediation—Vadose Zone and Ground Water Simultaneously: The device can be used to remediate or cleanup contaminated soil and ground water simultaneously by constructing the device with the distal perforated section below the water table and the proximal perforated section above the water table. In this configuration the inner or distal conduit can be used to either withdraw water as described above or to inject clean air into the contaminated geologic stratum. Injecting clean air in this manner removes or degrades contaminants in the water and bound to the soil through volatilization or through increasing the rates of contaminant-degrading biological processes. Volatilization of contaminants occurs when the clean air comes in contact with the contaminated soil or water, there by inducing a concentration gradient that draws the contaminant out of the water or soil and into the air. The now-dirty air rises through buoyancy to above the water table where it either migrates away without treatment of is captured by an air stream induced by a simultaneous vapor extraction effort described below. Contaminated soils are cleaned by attaching a vacuum-inducing device to the proximal, outer conduit, and thereby inducing air circulation through the contaminated soils. The contaminant vapors in the soil (and the additional contaminant vapors generated by the volatilization mechanism described above) are removed through the proximal outer conduit and are either discharged to the atmosphere of are treated above ground. Use of the device in this manner allows the flow out of or flow into individual geologic stratum transverse by the perforated portions of the device to be individually controlled.

Ground Water Monitoring/Assessment: The device can be constructed to determine the quality of the ground water transverse by the individual saturated geologic stratum. The only modification to the device described above is the placement of at least one of the perforated sections below the water table and the installation of a third sampling conduit into the space between the inner and outer conduits. The distal portion of the third conduit is perforated to allow infiltration of water. The inner most distal conduit is sampled by inserting or attaching a purging device to the proximal end of the inner conduit, and then activating or using the purging device to remove an appropriate volume of water, which is then collected for analysis in accordance with standard industry procedures. Similarly the outer or proximal conduit can be used for assessing water quality if the perforated section of the upper conduit is wholly or partially submerged below the water table. In this application the third conduit installed between the inner and outer conduit described above is used to collect the sample. It is also possible, although more problematic, to collect water samples from the outer conduit without the use of the third conduit.

CONCLUSION, RAMIFICATIONS AND SCOPE OF INVENTION

While the above description contains many specifications, these should not be construed as limiting the scope of the invention, but rather as only one application of the invention. Many variations are possible. For example numerous variations and applications are easily achieved by changing the size, placement, materials or use of the device. Accordingly, the scope of the invention should not be determined by the illustrated embodiments, but rather by the appended claims and their legal equivalents. Examples of variations to the embodiment illustrated above include:

Multiple Completions: The device can be constructed with an unlimited number of conduits. However, restrictions imposed by drilling technologies and the difficulty of transporting fluids through small annular openings makes installation of more than three to four conduits in a single borehole difficult.

Drilled Borehole with Pushed Drive Point: Combination drilling techniques can be used to install multiple completion wells co-axially. Using this approach, the borehole is first drilled to the depth of the distal end of proximal geologic stratum of interest. A steel rod whose distal portion contains perforations is then placed into the open borehole and is hydraulically advanced to the desired position beyond the distal portion of the proximal geologic stratum of interest. The distal portion of the borehole is then sealed using a progressively hardening liquid and a larger diameter upper conduit is then lowered over the inner conduit and is sealed in place with a granular filter pack and a solid or semi-solid sealant.

Angled and Horizontal Completion: The device can also be installed in a horizontal or angled configuration similar materials and procedures.

Retrofitting a Single Completion Well Into a Multiple-completion Coaxial Well: A traditional single completion vadose zone or ground water monitoring well can be easily converted into a double or multiple completion well by performing the following procedures:

1) Drilling a small hole in the bottom cap of the existing well. The hole diameter should be slightly larger than the diameter of the inner drive rod to be inserted into the middle of the existing well.
2) Placing a steel drive point inside the drilled hole and then hydraulically pushing the drive point to the desired position beyond the distal limit of the existing well.
3) Removing the drive rods and sealing the distal portion of the existing well with a barrier seal.

I claim:

1. A devise for use in remediation of a multiplicity of adjacent sub-surface geologic strata, said devise comprising:

an inner conduit with an outer surface and a distal first end and a proximal second end, a seal closing the distal first end and a plurality of perforations adjacent to the distal first end, said inner conduit positioned axially within a borehole with an inner wall traversing an upper sub-surface stratum, and at least part of a lower stratum, each stratum with an upper and a lower border. Said conduit positioned such that the distal first end and adjacent perforations are located within the lower stratum;

A distal granular filtration material surrounding the perforated interval of said inner conduit and extending adjacent to the proximal border of the most distal stratum, said filtration material extending axially from the outer surface of the inner conduit to the inner wall of the borehole;

a first barrier plug affixed to the outer surface of the inner conduit and distal from the distal end of the inner conduit and adjacent perforations and proximal to the proximal border of the most distal stratum, said barrier plug extending from the proximal border of the aforementioned filtration material to the distal border of the proximal geologic stratum and axially from the outer surface of the inner conduit to the inner wall of the borehole and plugging the borehole thereby;

an outer conduit positioned concentric with and surrounding the inner conduit, the outer conduit having an outer surface, a distal end and a proximal end, a seal attached to the distal end of the outer conduit surrounding the inner conduit and closing the distal end of the outer conduit, and a plurality of perforations adjacent to the distal end, the outer conduit projecting such that the distal end and adjacent perforations traverse an adjacent stratum above the lower traversed stratum;

a second granular filtration material surrounding the perforated interval of said outer conduit and extending adjacent to the proximal border of the most proximal stratum, said filtration material extending axially from the outer surface of the outer conduit to the inner wall of the borehole;

a second barrier plug affixed to the outer surface of the second conduit and distal from the distal end and adjacent perforations and proximal to the upper border of the upper stratum, said barrier plug extending axially from the second conduit to the inner wall of the borehole and plugging the borehole thereby; and, the proximal ends of both conduits adapted to accept pumping remediation devices.

2. The device described in claim 1 wherein the inner conduit is separated from the outer conduit by a seal connected to both the inner and the outer conduits and concentrically placed surrounding the inner conduit.

3. The device of claim 1 wherein the first and second barrier plugs comprise a liquid with properties that cause it to progressively harden to a solid or semi-solid after it is placed into the borehole.

4. The device of claim 1 additionally comprising a third conduit with a plurality of perforations adjacent to its distal end; said third conduit concentrically positioned between the inner and the outer conduits.

5. The device of claim 1 additionally comprising a multiplicity of concentrically positioned conduits positioned between the inner and outer conduits.

6. A method of removing contaminants in a multiplicity of adjacent geologic strata comprising:

preparing a borehole with an inner wall and traversing an upper and at least part of a lower terrestrial stratum, each stratum with an upper and lower border;

positioning a first inner conduit with an outer surface, a first end distal to the terrestrial surface and a second end, a seal plugging the first end, and a plurality of perforations adjacent to the first end, said inner conduit positioned axial within the borehole such that the first end and adjacent perforations are located within the lower stratum;

adding a granular filtration material to the borehole external to the first conduit and adjacent to the perforations of the first conduit;

affixing a first barrier plug to the outer surface of the inner conduit distal from the first end and adjacent perforations, and proximate to the upper border of the lower stratum, said barrier plug extending axially from the inner conduit to the inner wall of the borehole and plugging the borehole thereby;

positioning a second conduit concentric with and surrounding the inner conduit, the second conduit having an outer surface a first end distal to the terrestrial surface and a second end, a seal continuous with and surrounding the inner conduit and plugging the first end of the second conduit, and a plurality of perforations adjacent to the first end, the second conduit projecting such that the first end and adjacent perforations are located within an adjacent stratum above the lower traversed stratum; adding a granular filtration material to the borehole external to the second conduit and adjacent to the perforations of the second conduit;

affixing a second barrier plug to the outer surface of the second conduit, distal to the first end and adjacent perforations, and proximate to the upper border of the upper stratum, said barrier plug extending axially from the second conduit to the inner wall of the borehole and plugging the borehole thereby;

attaching pumping devices to the second end of the first and second conduits; and, pumping materials from the strata.

7. The method of claim 6 wherein the contaminant is transported as either a vapor or liquid phase fluid.

8. The method of claim 6 wherein fluids are removed from or injected into one or more geologic stratum.

9. A method of assessing contamination in multiple subsurface geologic strata comprising:

preparing a borehole with an inner wall and traversing an upper and at least part of a lower terrestrial stratum, each stratum with an upper and lower border;

positioning a first inner conduit with an outer surface, a first end distal to the terrestrial surface and a second end, a seal plugging the first end, and a plurality of perforations adjacent to the first end, said inner conduit positioned axial within the borehole such that the first end and adjacent perforations are located within the lower stratum;

adding a granular filtration material to the borehole external to the first conduit and adjacent to the perforations of the first conduit;

affixing a first barrier plug to the outer surface of the inner conduit distal from the first end and adjacent perforations, and proximate to the upper border of the lower stratum, said barrier plug extending axially from the inner conduit to the inner wall of the borehole and plugging the borehole thereby;

positioning a second conduit concentric with and surrounding the inner conduit, the second conduit having an outer surface a first end distal to the terrestrial surface and a second end, a seal continuous with and surrounding the inner conduit and plugging the first end of the second conduit, and a plurality of perforations adjacent to the first end, the second conduit projecting such that the first end and adjacent perforations are located within an adjacent stratum above the lower traversed stratum;

adding a granular filtration material to the borehole external to the second conduit and adjacent to the perforations of the second conduit;

affixing a second barrier plug to the outer surface of the second conduit, distal to the first end and adjacent perforations, and proximate to the upper border of the upper stratum, said barrier plug extending axially from the second conduit to the inner wall of the borehole and plugging the borehole thereby;

attaching pumping devices to the second end of the first and second conduits;

pumping material from each stratum; and, assaying the material collected thereby.

* * * * *